US005415289A

United States Patent [19]

Kim

[11] Patent Number: 5,415,289

[45] Date of Patent: May 16, 1995

[54] CARRYING PACKAGE OF PANCAKE REELS AND METHOD OF RECOVERING THE PACKAGE AFTER USE

[75] Inventor: Ha Y. Kim, Suwon, Rep. of Korea

[73] Assignee: S K M Ltd., Seoul, Rep. of Korea

[21] Appl. No.: 29,181

[22] Filed: Mar. 10, 1993

[30] Foreign Application Priority Data

Mar. 25, 1992 [KR] Rep. of Korea ..... 4701/1992
Mar. 25, 1992 [KR] Rep. of Korea ..... 4848/1992

[51] Int. Cl.[6] ..... B65D 85/66; B65D 19/00

[52] U.S. Cl. ..... 206/394; 206/386; 206/391

[58] Field of Search ..... 206/386, 596, 597, 600, 206/394, 391, 303, 416, 451; 108/55.3

[56] References Cited

U.S. PATENT DOCUMENTS

| | | | |
|---|---|---|---|
| 3,021,044 | 2/1962 | Schubert | 206/386 |
| 3,485,351 | 12/1965 | Nixon | 206/451 |
| 3,880,286 | 4/1975 | Wegener | 206/451 X |
| 3,949,929 | 4/1976 | Kupersmit | 206/600 X |
| 4,030,600 | 6/1977 | Heaps | 206/597 |
| 4,120,398 | 10/1978 | Braddon, Sr. | 206/303 X |
| 4,397,246 | 8/1983 | Ishida et al. | 108/55.3 |
| 4,792,044 | 12/1988 | Nishizawa et al. | 206/303 X |
| 5,086,919 | 2/1992 | Toral et al. | 206/394 X |
| 5,205,411 | 4/1993 | Born et al. | 206/391 |
| 5,205,412 | 4/1993 | Krieg | 206/394 |
| 5,251,753 | 10/1993 | Pigott et al. | 206/386 |

FOREIGN PATENT DOCUMENTS

| | | | |
|---|---|---|---|
| 0321099 | 6/1989 | European Pat. Off. | 206/386 |

*Primary Examiner*—Paul T. Sewell

*Assistant Examiner*—Beth Anne C. Cicconi

*Attorney, Agent, or Firm*—Martin Smolowitz

[57] ABSTRACT

A carrying package of pancake reels which are made by winding magnetic tapes on hubs and a method of recovering the carrying package after use are provided. The carrying package comprises a pallet, a body, a lower cap, an upper cap and bonding bands. The body has four walls which are interconnected and in which packing units, two lattices and an intermediate plate are disposed. The body has a height in which the packing units are laid on the other packing units via the intermediate plate forming two layers of the packing units. The lattices function as a partition wall for defining multiple compartments corresponding to the numbers of the packing units. The packing unit comprises two plastic discs, a plastic core, pancake reels, an intermediate film and sponge pads.

The method of recovering the carrying package after use comprises the steps of forming the plastic disc into square shapes having its side length as dimension 2A, forming the length from the outermost edge of the plastic disc to the outermost edge of the other plastic disc via pancake reels as dimension A, forming the internal length of one side of the body as 6A, piling up the used plastic discs on the lower cap to the height of the body in the first row in the body but in the second and third rows to the height which is two layers of the plastic cores lower than the height of the body, piling up the used plastic cores onto there as two layers, fitting the upper cap onto the body, and bonding the bands, thereby making three carrying packages to be recovered as one package.

2 Claims, 6 Drawing Sheets

CARRYING PACKAGE OF PANCAKE REELS AND METHOD OF RECOVERING THE PACKAGE AFTER USE

FIELD OF THE INVENTION

This invention relates to a carrying package of pancake reels and a method of recovering the package after use. It relates more specially to such a carrying package of pancake reels which are made by winding the magnetic tapes on the hubs and a method of recovering the carrying package after use.

BACKGROUND OF THE INVENTION

In the prior art, in order to pack rolled products such as non-woven fabric, high-grade film disc, aluminum foil disc and polyester film disc, wooden boxes, corrugated cardboard boxes, plastic boxes, etc. are generally used together with pads for fixing the products. In general, the rolled products are packed with thin and waterproof packing materials and laid on wooden pallets for carrying.

However, the prior art packages require much work. In addition, although the once used packing materials need to be recovered in view of the public nuisance and utilization of the resources, they require much transportation costs due to their large volume. Furthermore, the prior art wooden pallets are easily damaged by the forks of fork lifts, thus making the rolled products damaged.

SUMMARY OF THE INVENTION

It is therefore an object of the present invention to provide a carrying package of pancake reels and a method of recovering the carrying package after use which can solve the above problems.

In order to attain the above object, the present invention provides a carrying package of the pancake reels comprising a pallet made of plastic having through holes for being inserted by forks of a fork lift, a body having four walls which are interconnected and in which packing units, two lattices and an intermediate plate are disposed, a lower cap which is laid on the pallet and on which the packing units and the lattice are disposed, an upper cap which is laid on the body, and bonding bands, said lattice functioning as a partition wall for defining multiple compartments coresponding to the numbers of the packing units, the body having a height in which the packing units are laid on the other packing units via the intermediate plate forming two layers of the packing units.

The packing unit comprises two plastic discs, a plastic core, pancake reels, a intermediate film and sponge pads.

The method of recovering the carrying package after use comprises the steps of forming the plastic disc into square shapes having an overall thickness dimension A and having its side length as 2A, forming the length from the outermost edge of the plastic disc to the outermost edge of the other plastic disc via pancake reels as dimension A, forming the internal length of one side of the body as 6A, piling up the used plastic discs on the lower cap to the height of the body in the first row in the body but in the second and third rows to the height which is two layers of the plastic cores lower than the height of the body, piling up the used plastic cores onto there as two layers, fitting the upper cap onto the body, and bonding the bands, thereby making three carrying packages to be recovered as one package.

DETAILED DESCRIPTION OF THE PREFERRED EMBODIMENT

Figure 2:
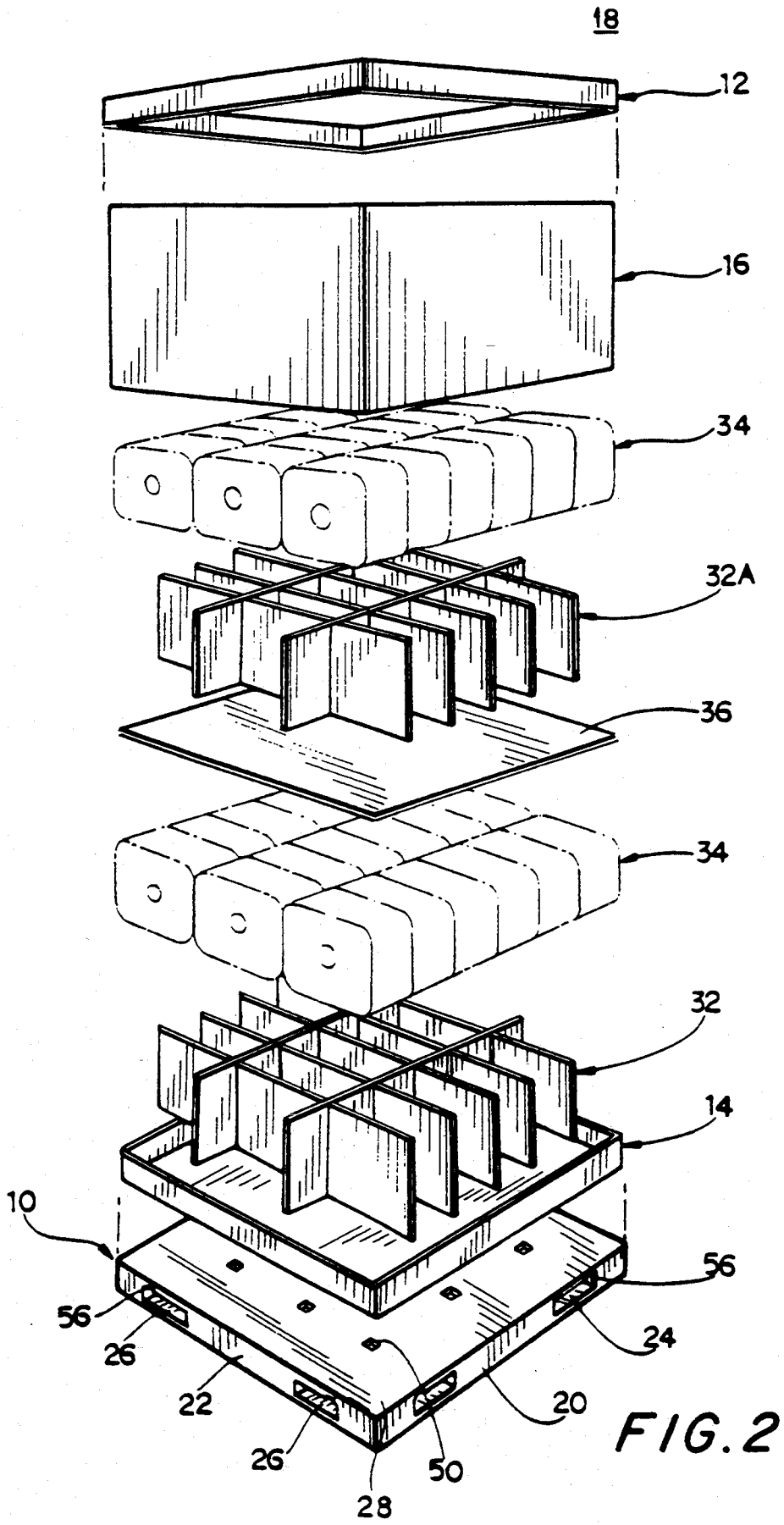
FIG. 2 is an exploded view of the carrying package for the packing units of the present invention.

Referring to the drawings and particularly to FIG. 2, the carrying package of the present invention, which is generally indicated at 18, comprises an upper cap 12, a body 16 having four outer walls which are interconnected, two lattices 32 and 32A, an intermediate plate 36, a lower cap 14 and a pallet 10 made of plastic.

The pallet 10 has two through holes 24 in the front face 20 and two through holes 26 in the lateral face 22 for being inserted by a fork of the fork lift. The through holes 24 and the through holes 26 are crossed and made as large as possible to lessen the weight of the pallet provided that its strength permits. The pallet 10 has multiple rubber packings 50 separately disposed on its upper surface 28 for preventing the slipping of the lower cap 14 on the pallet.

The lower cap 14 has a size slightly smaller than the size of the pallet 10 and has a box-like shape opened upwards. Between the lower cap 14 and the intermediate plate 36 and between the intermediate plate 36 and the upper cap 12, the lattices 32, 32A made of corrugated cardboard are provided for preventing wear of packing units 34 due to the contacting. Each of lattices 32, 32A functions as a partition wall for eighteen($=3\times6$)compartments. The body 16 has a height in which two layers of packing units are disposed(that is, eighteen($=3\times6$)packing units 34 are disposed on the other eighteen($=3\times6$)packing units 34)via the intermediate plate 36. The internal length of one side of the body 16 equals to dimension 6A, as explained hereinbelow. The upper cap 12 is disposed on the body 16.

Figure 1A:
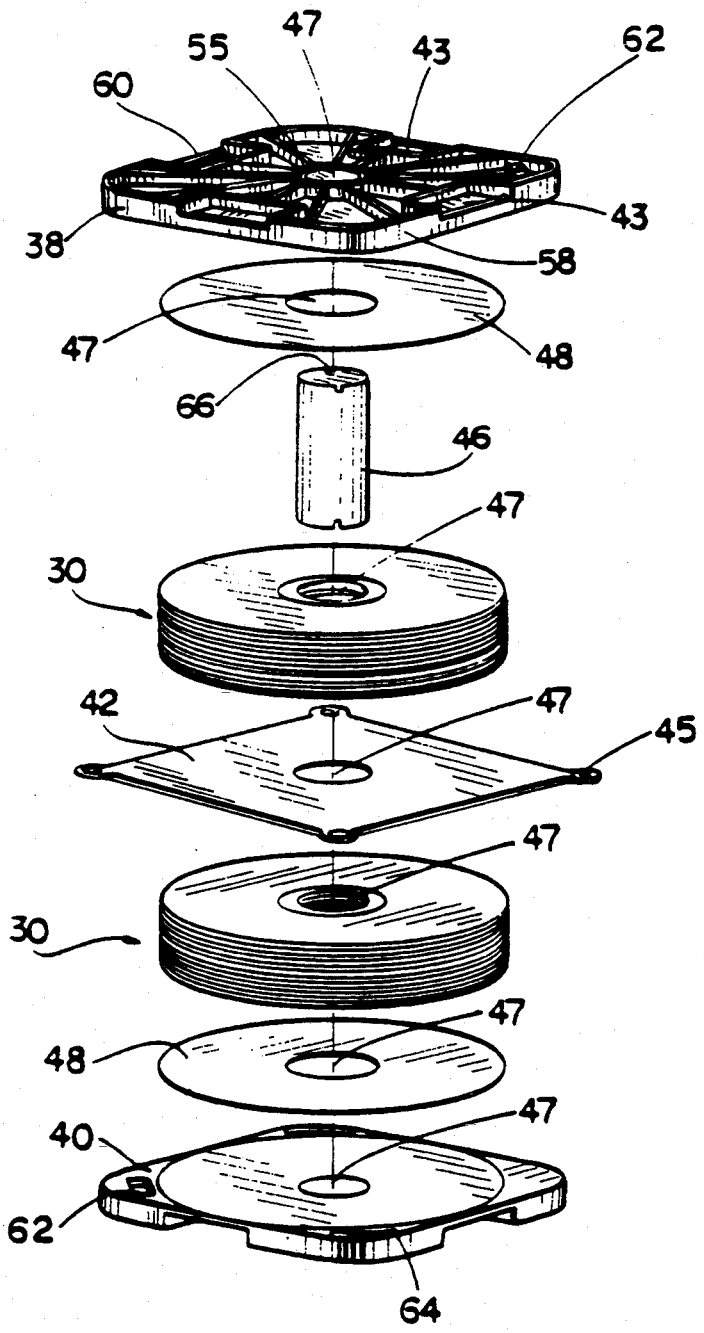
FIG. 1A is an exploded view of the packing unit of the present invention.
Figure 1B:
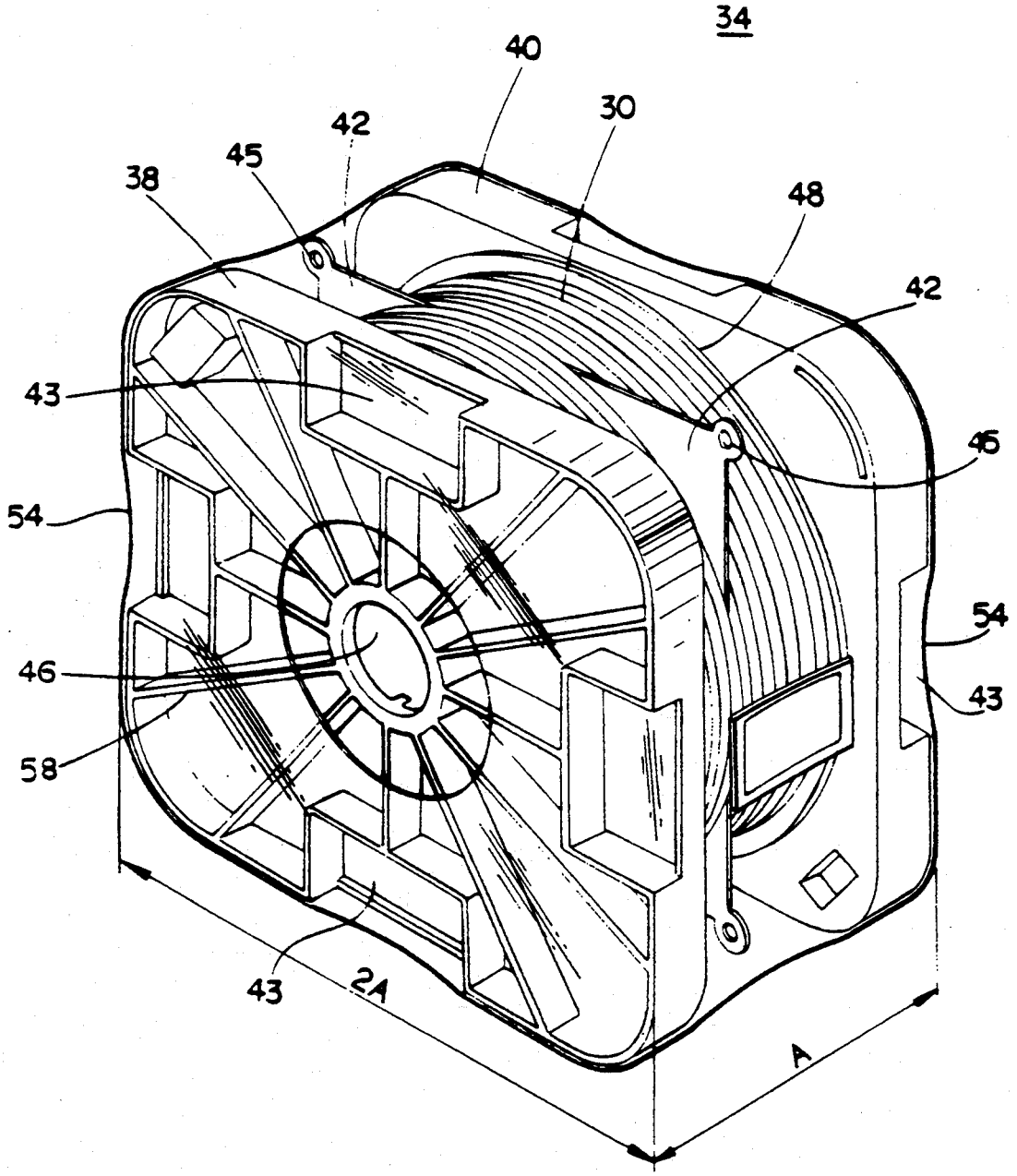
FIG. 1B is a perspective view of the packing unit of the present invention in assembled state.

The packing unit 34 shown in FIGS. 1A and 1B comprises two plastic discs 38, 40, a plastic core 46, two pancake reels 30, an intermediate film 42 and two sponge pads 48. The packing unit length from the outermost edge of the plastic disc 38 to the outermost edge of the other plastic disc 40 via pancake reels 30 equals to dimension A. Each of plastic discs 38, 40 has a square shape(the length of one side equals to 2A)with round corners and has a center through hole 47. The plastic disc 38, 40 has radial reinforcing ribs on the outer surface and has a protrusion 55 on the circular rib formed on the periphery of the central through hole 47. The plastic disc 38, 40 has a recess 43 for being gripped by hand on each side together with a slip prevention protrusion 60. On the inner surface of one corner of the plastic disc 38, 40, a cavity 62 for receiving a moisture-proofing agent bag is formed and on the other opposed corners of the plastic disc 38, 40, a protrusion 64 is formed to prevent the plastic disc 38, 40 from slipping when they are piled up for recovery after use. The plastic core 46 is adapted to be inserted into the central through holes 47 of two pancake reels 30. The plastic core 46 has a hollow cylindrical shape and has a cutting or notch 66 on the upper end and lower end thereof for receiving the protrusion 55 of the plastic disc 38, 40. The intermediate film 42 is disposed between the two pancake reels 30 and has a square shape with round corners having grips 45. The sponge pads 48 are disposed between the pancake reels 30 and the plastic disc 38, 40. Wrapping film is indicated at 54 (FIG. 1B) for the packing unit 34.

Figure 3:
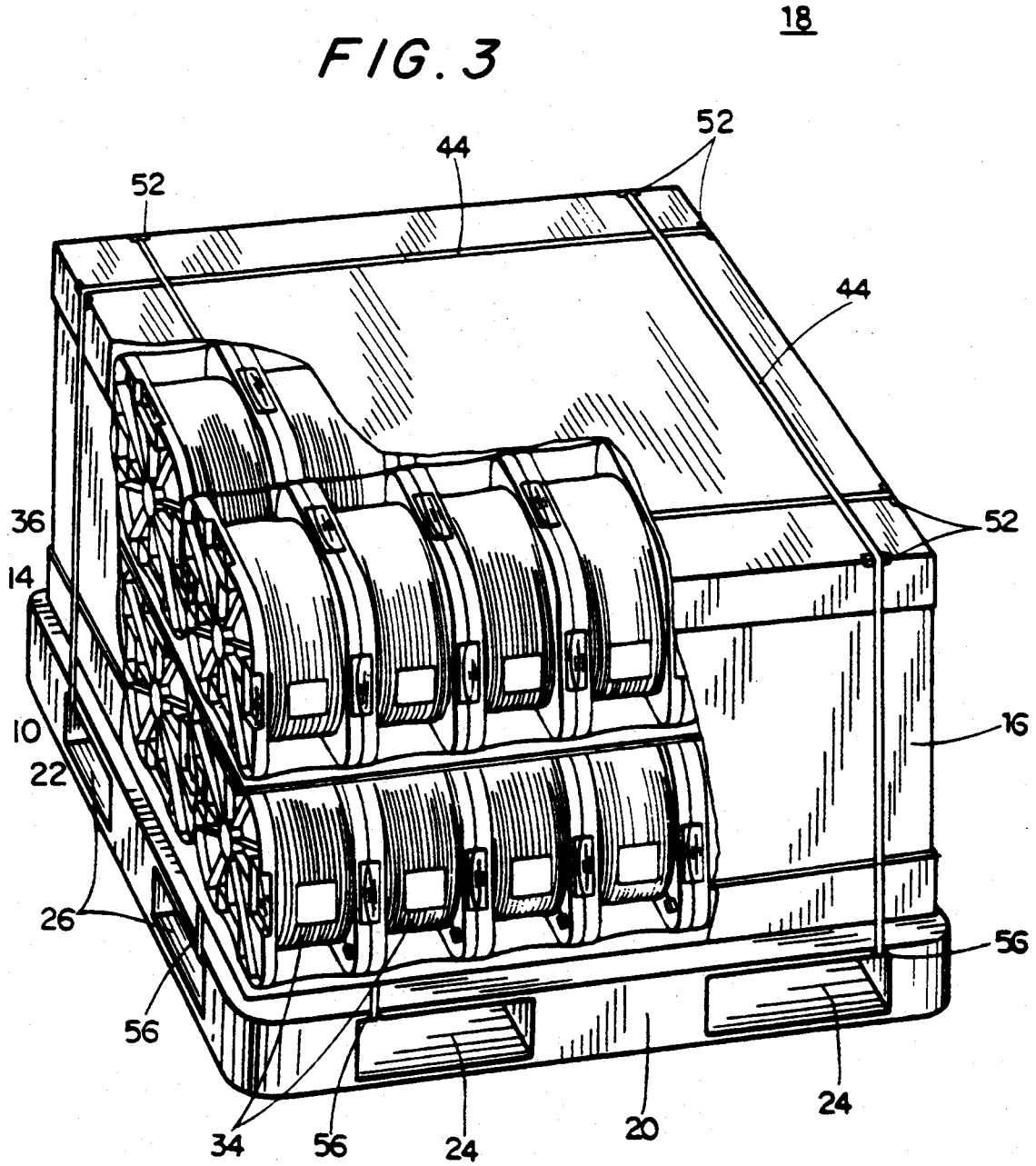
FIG. 3 is a perspective view and a partially cutaway view of the carrying package of the present invention in packed and bonded state.

As best shown by FIG. 2, the carrying package 18 of the present invention is made as follows. At first, the lower cap 14 is laid on the pallet 10 and the lattice 32 is laid on the lower cap 14, as shown in FIG. 2. Next, eighteen packing units 34 are put into the compartments formed by the lattice 32 and the intermediate plate 36 is laid on the packing units 34 and the lattice 32. And, the lattice 32A and eighteen packing units 34 are laid on the intermediate plate 36. Then, the body 16 is fitted into the lower cap 14, and the upper cap 12 is fitted onto the body 16. After being bonded together by the bands 44 made of steel or synthetic resin as shown in FIG. 3, the carrying package 18 is to be carried to the other place using the through holes 24, 26 of the pallet 10.

Figure 4:
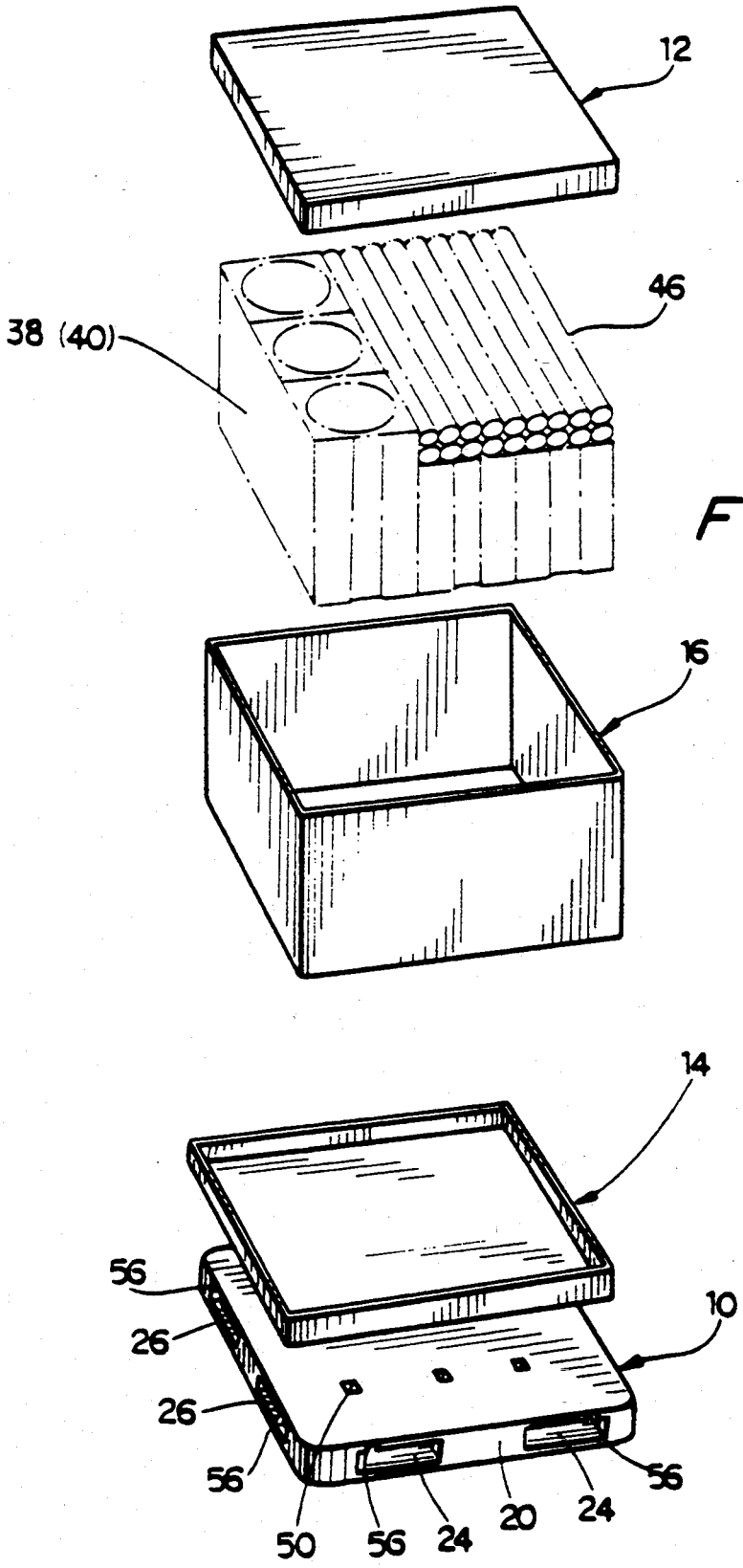
FIG. 4 is an exploded view of the carrying package showing the method of recovering the package after use.
Figure 5:
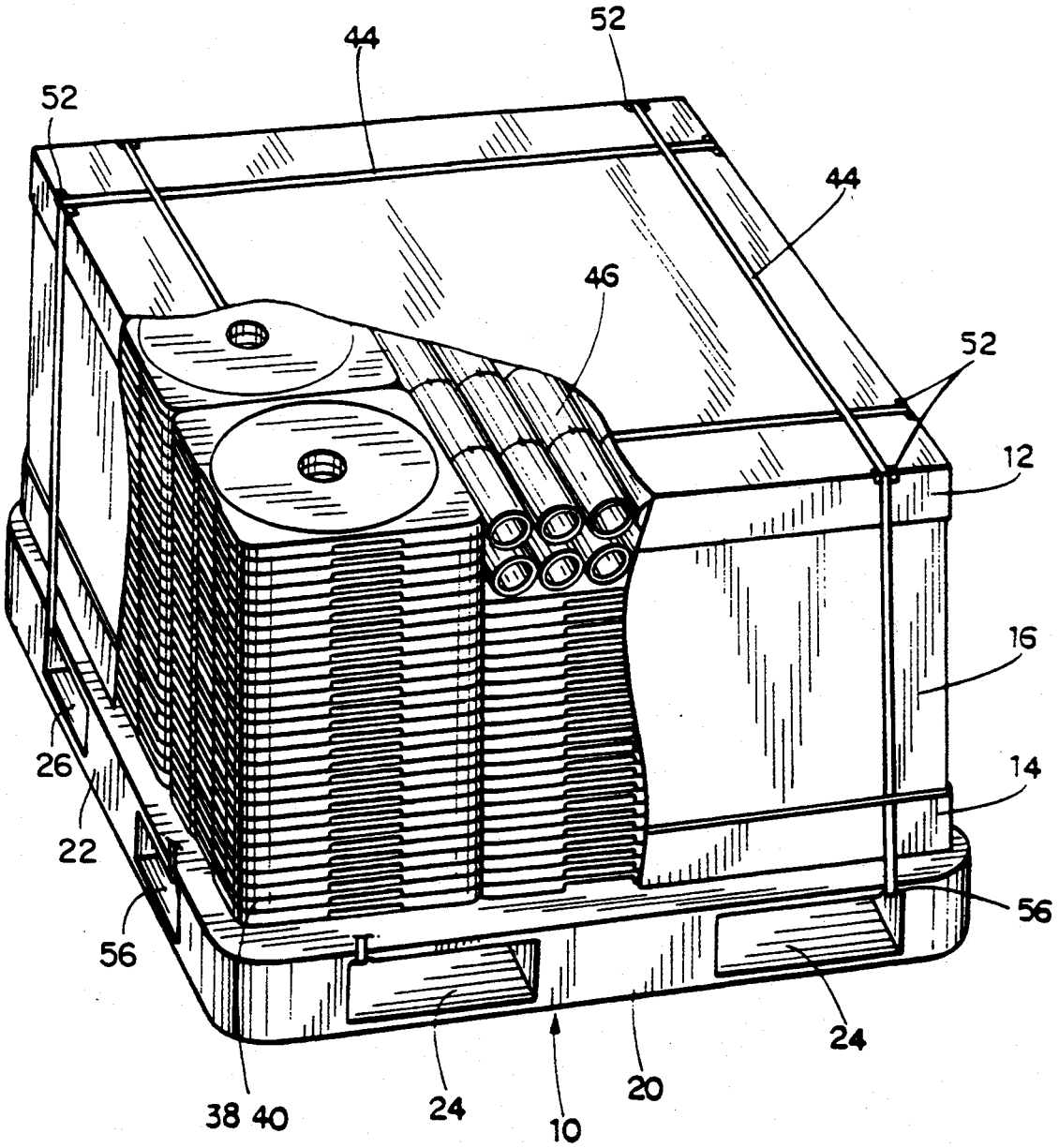
FIG. 5 is a perspective view and a partially cutaway view of the carrying package showing the method of recovering the package after use in packed and bonded state.

After use, the carrying package 18 is recovered according to the present invention as follows. As shown in FIGS. 4 and 5, the lower cap 14 is laid on the pallet 10 and the body 16 is fitted into the lower cap 14. After use of the pancake reels 30, the plastic discs 38, 40 and the plastic cores 46 are recovered but the intermediate films 42, the sponge pads 48 and others are not recovered. Inside the body 16, nine($=3\times3$)plastic discs 38, 40 are laid as one layer on the lower cap 14. Because the diametrical length of nine plastic cores equals to the side length of two plastic discs, the plastic discs 38, 40 are piled up to the height of the body 16 in the first row from the left in the drawings but in the second and the third rows the plastic discs 38, 40 are piled up to the height which is two layers of the plastic cores 46 lower than the height of the body 16 and two layers of the plastic cores 46 are piled up onto there. Thus, three carrying packages can be recovered as one package without having useless tolerance. Finally, the upper cap 12 is fitted onto the body 16 and the bonding work is made.

Of course, modifications and variations in the constructions are possible in light of the above techniques. For example, a groove 56 for the bonding band 44 may be formed in the through holes 24, 26 in order to prevent the bonding band 44 from damage due to the fork of the fork lift and corner pieces 52 may be mounted onto the upper cap 12 in order to prevent the upper cap 12 from damage. Further, the bonding band 44 may be arranged to pass over the position in which the plastic discs 38, 40 contact each other in order to prevent the upper cap 12 and/or pancake reels 30 from damage.

By using the carrying package of pancake reels and the method of recovering the package after use according to the present invention, packing work can be made easily and efficiently without damaging the pancake reels and packing materials. In addition, by the present invention, the once used packing materials which may be public nuisance can be recovered efficiently due to their compact piling-up and can be re utilized.

I claim:

1. A carrying package for pancake reels, comprising a pallet made of plastic and having at least two through holes for being inserted by forks of a fork lift;

a body having four outer walls which are interconnected and in which multiple packing units, two lattices and an intermediate plate are disposed within the body;

each said packing unit comprising two plastic discs, a plastic core, multiple pancake reels, an intermediate film provided between the pancake reels and sponge pads provided between the pancake reels and the plastic discs, each said plastic disc having a square shape with round corners and having a center through hole, each said plastic disc having radial reinforcing ribs on the disc outer surface and having a protrusion on a circular rib formed on the periphery of the central through hole, each said plastic disc having a recess for being gripped on each side together with a slip prevention protrusion, each said plastic disc having a hole on the inner surface of one corner, each said plastic disc having a protrusion on the other opposed corners to prevent them from slipping when they are piled up for recovering after use, and said plastic core having a hollow cylindrical shape and having a cutting on both ends for receiving the protrusion of the plastic discs;

a lower cap which is laid on the pallet and on which the packing units and the two lattices are disposed;

an upper cap which is laid on the body, each said lattice functioning as a partition wall for defining compartments corresponding to the number of the packing units, said body having a height in which the packing units are laid on other packing units via the intermediate plate for forming two layers of the packing units in the body; and multiple bonding bands being arranged to encircle and bond together the carrying package.

2. A method of recovering a carrying package and pancake reels after use, comprising the steps of providing a carrying package for pancake reels comprising a pallet made of plastic and having at least two through holes for being inserted by forks of a fork lift; a body having four outer interconnected walls and in which multiple packing units, two lattices and an intermediate plate can be disposed, a lower cap laid on the pallet and on which the packing units and the lattices can be disposed, an upper cap laid on the body, said body having a height in which the packing units can be laid on other packing units via the intermediate plate for forming two layers of the packing units; and multiple bonding bands arranged to encircle and bond together the carrying package; and forming a plurality of plastic discs into square shapes having an overall thickness A and having its side length as dimension 2A forming the length from the outermost edge of the plastic discs to the outermost edge of other plastic discs via pancake reels as the dimension A; forming the internal length of one side of the body as dimension 6A, and piling up used plastic discs on the lower cap to the height of the body in the first row in the body, but in the second and third rows to the height which is two layers of the plastic cores lower than the height of the body, piling up used plastic cores onto there as two layers, fitting the upper cap onto the body; and bonding the bands around the recovered package, thereby making three carrying packages to be recovered as one recovered package.

* * * * *